US007484442B1

(12) United States Patent
Chen

(10) Patent No.: US 7,484,442 B1
(45) Date of Patent: Feb. 3, 2009

(54) TORQUE ADJUSTABLE SCREWDRIVER HAVING A TORQUE INDICATOR

(76) Inventor: Chang-Ying Chen, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 11/776,534

(22) Filed: Jul. 11, 2007

(51) Int. Cl.
*B25B 23/157* (2006.01)

(52) U.S. Cl. ..... 81/475; 81/474

(58) Field of Classification Search ..... 81/475, 81/473, 477, 474, 467
See application file for complete search history.

(56) References Cited

U.S. PATENT DOCUMENTS 6,095,020 A * 8/2000 Rinner ..... 81/475
6,640,674 B1 * 11/2003 Rinner et al. ..... 81/475
7,013,769 B2 * 3/2006 Chen ..... 81/473

* cited by examiner

*Primary Examiner*—David B Thomas

(57) ABSTRACT

A torque adjustable screwdriver having a torque indicator comprises a holding portion including a handle, a spring and a stopper which are received in the handle. An operation unit has a ratchet unit, a rotary rod, an exposed post, and a screwdriver head. The rotary rod is installed within the handle and passes through the spring and the stopper. The ratchet unit has an approximate cylinder shape and one end surface of the ratchet unit is formed as a sawteeth surface. In assembly, the rotary rod is engaged to the teeth of the enlarged end of the rotary rod. A setting unit includes a driving rod, a rotary unit, a resisting unit, and an adjusting cover. The rotary unit is a hollow cylinder with outer threads at one end. An inner side of the rotary unit has the outer threads being formed with teeth.

9 Claims, 4 Drawing Sheets

TORQUE ADJUSTABLE SCREWDRIVER HAVING A TORQUE INDICATOR

FIELD OF THE INVENTION

The present invention relates to screwdrivers, and particularly to a torque adjustable screwdriver having a torque indicator, wherein a pullable switch is formed for adjusting the length of the handle of the screwdriver so as to adjust the applied twisting force. Furthermore, an exposed post is installed for monitoring the permissible maximum twisting torque.

BACKGROUND OF THE INVENTION

In one prior art screwdriver, the screwdriver has a handle, a torsion unit, an actuation unit, a stopper, and a cover. The tension unit has a spring and a slide block. The spring is received in a receiving space of the handle. A periphery of the sliding block has a track corresponding to the guide groove of handle. The slide block is installed on the track and is stopped by the spring. The actuation unit has an actuate element and a driving rod which are integrally formed. One end of the driving rod is formed as a driving end which passes through the through hole of the slide block, and the holes of the tension unit and the handle. The actuate element is installed with push surface corresponding to a push surface of the slide block. The driving rod is formed with a positioning portion corresponding to a surface of the actuation unit. Thereby rotating the cover will set the twisting force applied.

However above mentioned structure cannot show the twisting force permissible. Thus the user can not know the set tension value easily. Furthermore, each time the screwdriver is used, the cover must be set again. Thus, the operation is inconvenient. Furthermore, only one end of the cover has the function of adjusting the twisting force. The effect is small.

SUMMARY OF THE INVENTION

Accordingly, the primary object of the present invention is to provide a torque adjustable screwdriver having a torque indicator, wherein a pullable switch is formed for adjusting the length of the handle of the screwdriver so as to adjust the applied twisting force. Furthermore, an exposed post is installed for monitoring the permissible maximum twisting torque.

To achieve above objects, the present invention provides a screwdriver, comprising: a holding portion including a handle, a spring, and a stopper; the handle being a hollow cylinder; one first end of the handle being formed with inner threads and having two cambered slots at two opposite sides; a second end of the handle also has inner threads; the stopper having a threaded hollow post; in assembly, the threaded hollow post being engaged to the outer threads of the second end of the handle; the spring being received in the hollow space of the handle; the operation unit having a ratchet unit, a rotary rod, an exposed post, and a screwdriver head; the rotary rod being a long rod; one end of the rotary rod being formed with an enlarged end; one end surface of the enlarged end having teeth; the rotary rod being installed within the handle and passing through the spring and the stopper; the spring resisting between one end of the enlarged end and the cap of the stopper; the ratchet unit having an approximate cylinder shape and one end surface of the ratchet unit being formed as a sawteeth surface; in assembly, the rotary rod being engaged to the teeth of the enlarged end of the rotary rod; and a setting unit including a driving rod, a rotary unit, a resisting unit, and an adjusting cover; the rotary unit being a hollow cylinder with outer threads at one end; an inner side of the rotary unit having the outer threads being formed with a teeth; the outer threads of the rotary unit being engaged to the inner threads of the handle; an end of the rotary unit without the outer threads resisting against one end of the ratchet unit; a middle section of the driving rod having a plurality of protruding teeth; one end of the driving rod being formed as an enlarged head; in assembly, the driving rod being installed within the handle; the enlarged head resists against the ratchet unit for limiting the movement of the driving rod; when the driving rod is pulled outwards, the teeth of the driving rod are engaged to the teeth of the rotary unit.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
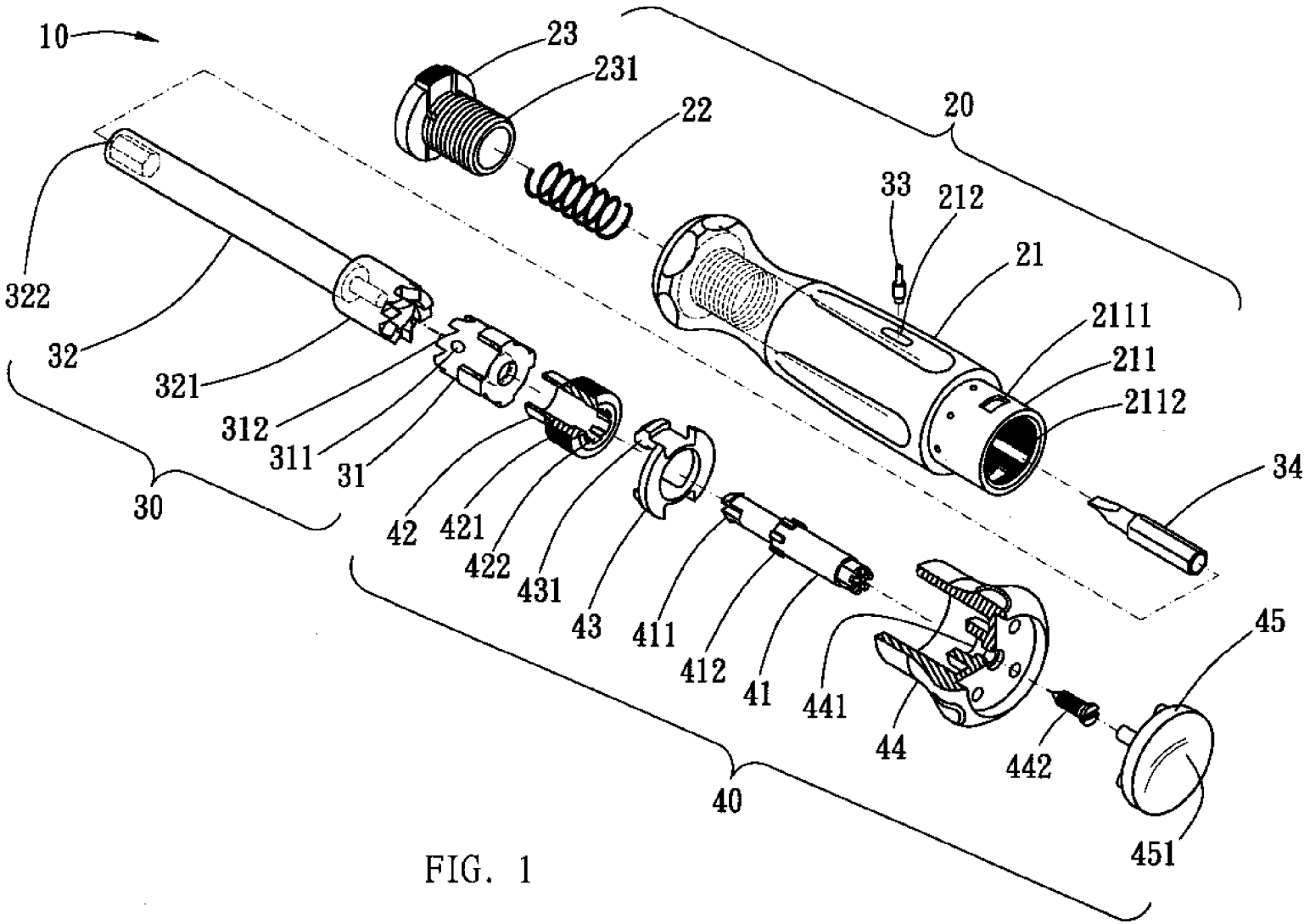
FIG. 1 is an explosive schematic view of the screwdriver of the present invention.
Figure 2:
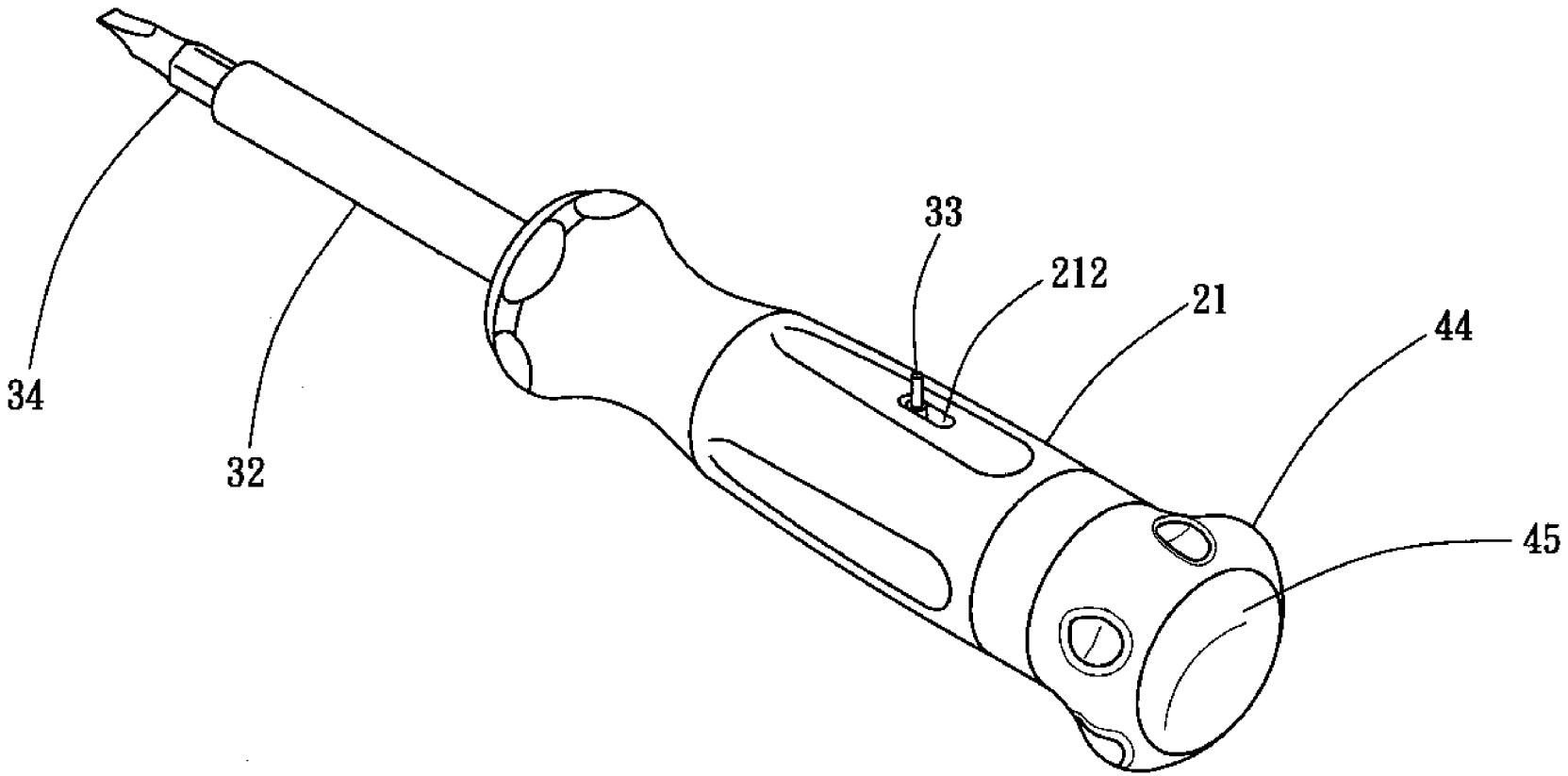
FIG. 2 is a schematic view showing the structure of the screwdriver of the present invention.

Referring to FIGS. 1 and 2, the structure of the present invention is illustrated. The present invention has the following elements.

A holding portion 20 includes a handle 21, a spring 22, and a stopper 23.

The handle 21 is a hollow cylinder. A middle section of the handle 21 has a long slot 212. One first end of the handle 21 is formed with inner threads 2112 and has two cambered slots 2111 at two opposite sides. A second end of the handle 21 also has inner threads.

The stopper 23 has an enlarged cap and a threaded hollow post 231 extended from the cap. In assembly, the threaded hollow post 231 is engaged to the outer threads of the second end of the handle 21. The spring 22 is received in the hollow space of the handle 21 and resists against the cap of the stopper 23.

The operation unit 30 has a ratchet unit 31, a rotary rod 32, an exposed post 33, and a screwdriver head 34. The rotary rod 32 is a long rod. One end of the rotary rod 32 is formed with an enlarged end 321. One end surface of the enlarged end 321 has teeth. The rotary rod 32 is installed within the handle 21 and passes through the spring 22 and the stopper 23. The spring 22 resists between one end of the enlarged end 321 and the cap of the stopper 23. A front end of the rotary rod 32 has a receiving groove 322 for receiving the screwdriver head 34. The ratchet unit 31 has an approximate cylinder shape and one end surface of the ratchet unit 31 is formed as a sawteeth surface 312. In assembly, the ratchet unit 31 is engaged to the teeth of the enlarged end 321 of the rotary rod 32. The teeth of the ratchet unit 31 may move through the teeth of the enlarged end 321 uni-directionally. The ratchet unit 31 has a connecting hole 311 which is corresponding to the long slot 212 of the handle 21 for installing the exposed post 33. The exposed post 33 passes through the long slot 212 of the handle 21.

A setting unit 40 includes a driving rod 41, a rotary unit 42, a resisting unit 43, an adjusting cover 44 and an end cover 45. The rotary unit 42 is a hollow cylinder with outer threads 421 at one end. An inner side of the rotary unit 42 having the outer threads 421 is formed with a straight teeth 422. The outer threads 421 of the rotary unit 42 is engaged to the inner threads 2112 of the handle 21. An end of the rotary unit 42 without the outer threads 421 resists against one end of the ratchet unit 31. The rotary unit 42 has a base ring. Two protruding blocks 431 protrude from the sheet. The two protruding blocks 431 are embedded into the two cambered slots 2111 of the handle 21 so as to confine the rotation thereof. The driving rod 41 is an approximate round post. A middle section of the driving rod 41 has a plurality of protruding teeth 412. One end of the driving rod 41 is formed as an enlarged head 411. In assembly, the driving rod 41 is installed within the handle 21. The enlarged head 411 resists against the ratchet unit 31 for limiting the movement of the driving rod 41. When the driving rod 41 is pulled outwards, the teeth 412 of the driving rod 41 are engaged to the teeth 422 of the rotary unit 42.

The adjusting cover 44 of the setting unit 40 has an approximate cylindrical shape. An interior of the adjusting cover 44 is formed with a retaining recess 441 for receiving one end of the driving rod 41 without the enlarged head. A stud 442 serves to combine retaining recess 441 to the driving rod 41. When the adjusting cover 44 is pulled, the driving rod 41 moves within the handle 21. The end cover 45 of the setting unit 40 is a round sheet and a cambered surface 451 at one outer side thereof.

Referring to FIGS. 3, 3*a*, 4, 4*a*, 5 and 6, the operation of the present invention are illustrated.

Figures 3, 3A, 4, 4A:
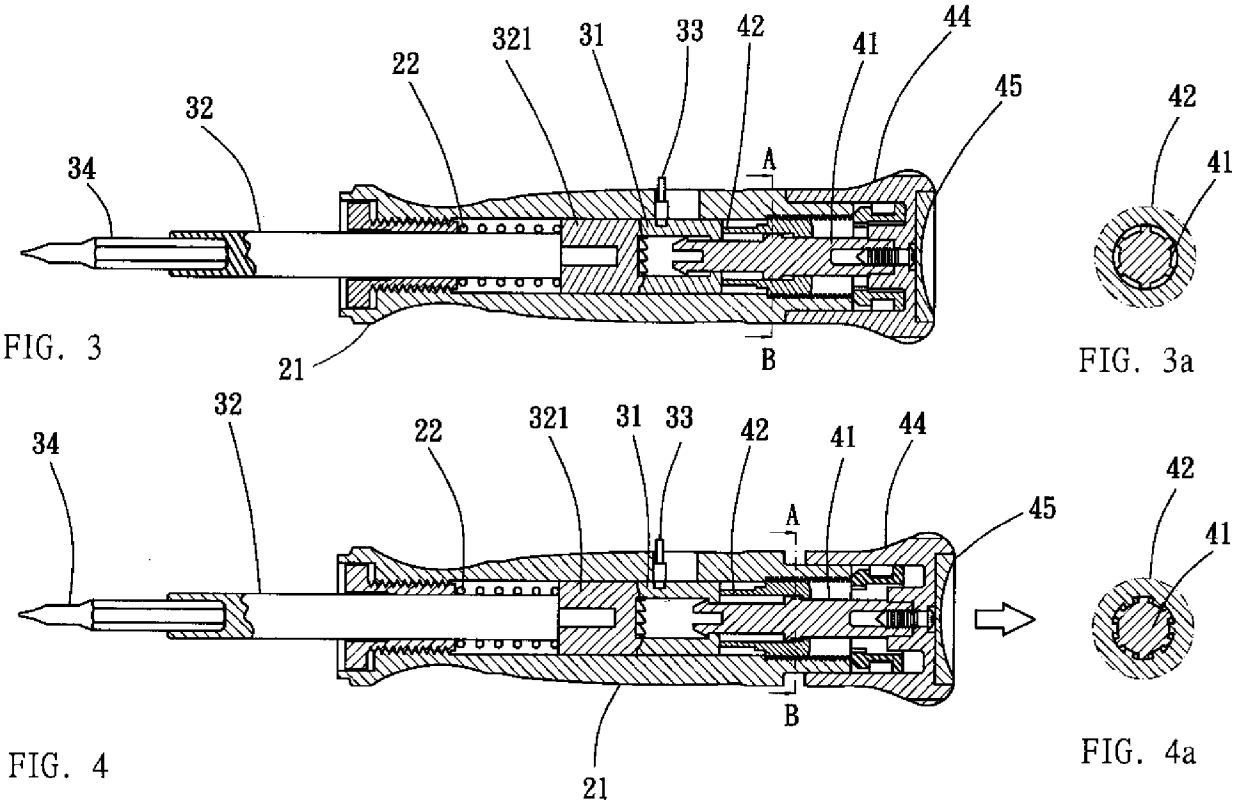
FIGS. 3 to 6 shows the operation of the present invention.
FIG. 3*a* is a schematic cross sectional view along line AB in FIG. 3.
FIG. 4*a* is a schematic cross sectional view along line AB in FIG. 4.
Figure 5:
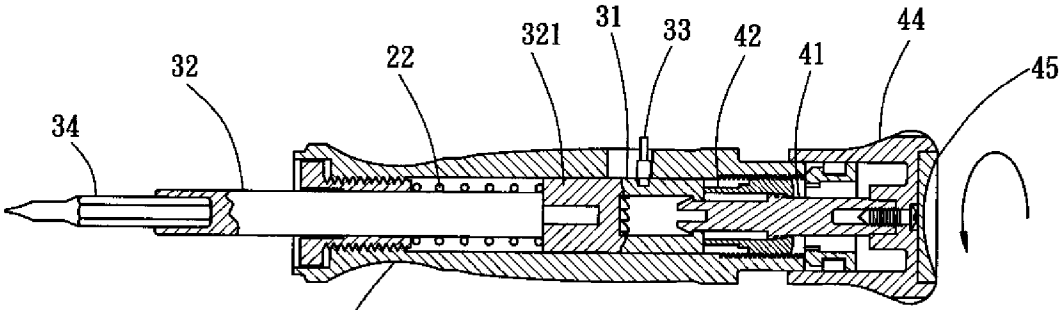
Figure 6:
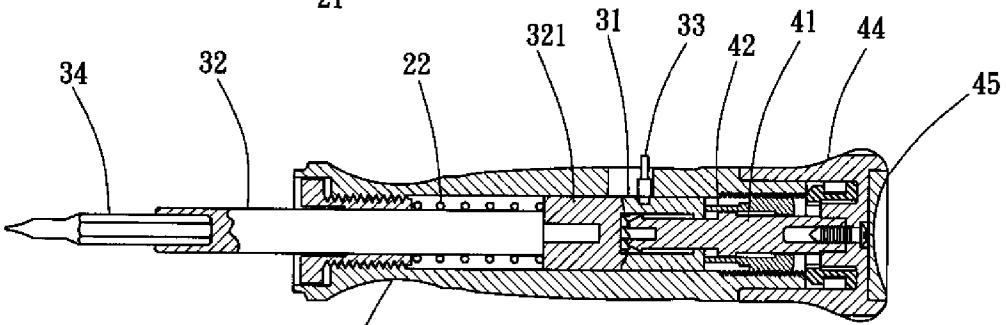

In FIGS. 3 and 3*a*, in normal state, the driving rod 41 of the setting unit 40 is not engaged to the teeth 422 of the rotary unit 42. The adjusting cover 44 is rotatable with respect to the handle 21. Referring to FIGS. 4 and 4*a*, when it is desired to adjust the length of the holding portion so as to change the applied twisting force, the adjusting cover 44 is pulled outwards so as to drive the driving rod 41 to cause the teeth 412 of the driving rod 41 is engaged to the teeth 422 of the rotary unit 42. Referring to FIG. 5, then the adjusting cover 44 is rotated further to drive the driving rod 41 and then to drive the rotary unit 42 to rotate. By the outer threads 421 of the driving rod 41 and the inner threads 2112 of the handle 21, the rotary unit 42 rotates. Thereby the operation unit 30 will compress or release the spring 22 of the handle 21. Furthermore, the exposed post 33 of the operation unit 30 moves. Referring to FIG. 6, after the length of the holding portion 20 is adjusted to a desired one, the adjusting cover 44 is compressed to a normal state. The driving rod 41 will not be engaged to the rotary unit 42 by the affect of the adjusting cover 44. When the teeth 321 of the rotary rod 32 move through the teeth of the ratchet unit 31 by the resisting force of the spring 22, the margin of the allowable twisting force can be monitored through the exposed post 33. The stopper 23 serves to adjust the maximum twisting force of the torsion screwdriver. By the outer threads 231 of the stopper 23, the stopper 23 screws in the handle 21 so as to change the force from the spring 22 to the operation unit 30.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A torque adjustable screwdriver having a torque indicator, comprising:

a holding portion including a handle, a spring, and a stopper;

the handle being a hollow cylinder; one first end of the handle being formed with inner threads and having two cambered slots at two opposite sides; and a second end of the handle also having inner threads;

the stopper having a threaded hollow post; in assembly, the threaded hollow post being engaged to the outer threads of the second end of the handle; the spring being received in the hollow space of the handle;

the operation unit having a ratchet unit, a rotary rod, an exposed post, and a screwdriver head; the rotary rod being a long rod; one end of the rotary rod being formed with an enlarged end; one end surface of the enlarged end having teeth; the rotary rod being installed within the handle and passing through the spring and the stopper; the spring resisting between one end of the enlarged end and the stopper; the ratchet unit having an approximate cylinder shape and one end surface of the ratchet unit being formed as a sawteeth surface; in assembly, the ratchet unit being engaged to the teeth of the enlarged end of the rotary rod; and a setting unit including a driving rod, a rotary unit, a resisting unit, and an adjusting cover; the rotary unit being a hollow cylinder with outer threads at one end; an inner side of the rotary unit having the outer threads being formed with a teeth; the outer threads of the rotary unit being engaged to the inner threads of the handle; an end of the rotary unit without the outer threads resisting against one end of the ratchet unit; a middle section of the driving rod having a plurality of protruding teeth; one end of the driving rod being formed as an enlarged head; in assembly, the driving rod being installed within the handle; the enlarged head resists against the ratchet unit for limiting the movement of the driving rod; when the driving rod is pulled outwards, the teeth of the driving rod are engaged to the teeth of the rotary unit.

2. The torque adjustable screwdriver having a torque indicator as claimed in claim 1, wherein the adjusting cover of the setting unit has an approximate cylindrical shape.

3. The torque adjustable screwdriver having a torque indicator as claimed in claim 2, wherein an interior of the adjusting cover is formed with a retaining recess for receiving one end of the driving rod without the enlarged head; and a stud serves to combine retaining recess to the driving rod.

4. The torque adjustable screwdriver having a torque indicator as claimed in claim 1, wherein the adjusting cover further comprises an end cover which has a round sheet and a cambered surface at one outer side.

5. The torque adjustable screwdriver having a torque indicator as claimed in claim 1, wherein a middle section of the handle having a long slot; the ratchet unit has a connecting hole which is corresponding to the long slot of the handle for installing the exposed post; and the exposed post passes through the long slot of the handle.

6. The torque adjustable screwdriver having a torque indicator as claimed in claim 1, wherein a front end of the rotary rod has a receiving groove for receiving the screwdriver head.

7. The torque adjustable screwdriver having a torque indicator as claimed in claim 1, wherein the rotary unit has a base ring; two protruding blocks protruding from the sheet; the two protruding blocks are embedded into the two cambered slots of the handle so as to confine the rotation thereof.

8. The torque adjustable screwdriver having a torque indicator as claimed in claim 1, wherein the driving rod is an approximately round post.

9. The torque adjustable screwdriver having a torque indicator as claimed in claim 1, wherein the stopper has an enlarged cap and a threaded hollow post extended from the cap; in assembly, the spring being received in the hollow space of the handle and resisting against the cap of the stopper.

* * * * *